US011952320B2

(12) United States Patent
Chang

(10) Patent No.: US 11,952,320 B2
(45) Date of Patent: Apr. 9, 2024

(54) AQUEOUS SOLUTION CONTAINING CARBOHYDRATE FOR GENERATING SMOKE AND METHOD FOR USING SAME TO GENERATE SMOKE

(71) Applicant: NOVACORP INC., Guangzhou (CN)

(72) Inventor: Ming-Cheng Chang, Tainan (TW)

(73) Assignee: NOVACORP INC., Guangdong Province (CN)

( * ) Notice: Subject to any disclaimer, the term of this patent is extended or adjusted under 35 U.S.C. 154(b) by 665 days.

(21) Appl. No.: 17/149,933

(22) Filed: Jan. 15, 2021

(65) Prior Publication Data

US 2021/0253493 A1 Aug. 19, 2021

(30) Foreign Application Priority Data

Feb. 19, 2020 (TW) ..... 109105356

(51) Int. Cl.
*C06D 3/00* (2006.01)

(52) U.S. Cl.
CPC ..... *C06D 3/00* (2013.01)

(58) Field of Classification Search
CPC ..... C06D 3/00
See application file for complete search history.

(56) References Cited

U.S. PATENT DOCUMENTS 5,122,362 A * 6/1992 Phillips ..... G01N 33/66 435/14
6,039,987 A * 3/2000 Strahl ..... A23L 2/38 426/654
6,287,618 B1 9/2001 Shinji et al.

FOREIGN PATENT DOCUMENTS

| | | | |
|---|---|---|---|
| DE | 102012024809 | A1 | 6/2014 |
| FR | 1236354 | A | 7/1960 |
| JP | H0884949 | A | 4/1996 |
| JP | 2004166606 | A | 6/2004 |

* cited by examiner

*Primary Examiner* — Robert S Jones, Jr.
*Assistant Examiner* — Jiangtian Xu
(74) *Attorney, Agent, or Firm* — Che-Yang Chen; Law Office of Michael Chen

(57) ABSTRACT

An aqueous solution (20) containing carbohydrate for generating smoke consists of 91.9-98.95 wt % of pure water, 1-8 wt % of carbohydrate, and 0.05-0.1 wt % of a water soluble aromatic substance of orange flavor. A method for generating smoke includes preparing an aqueous solution (20) including 91.9-98.95 wt % of pure water, 1-8 wt % of carbohydrate, and 0.05-0.1 wt % of a water soluble aromatic substance of orange flavor; and vibrating the aqueous solution (20) at a high frequency, causing gradual atomization from a surface of the aqueous solution (20) to form droplets containing the carbohydrate and having a diameter in a range of 6-20 μm.

13 Claims, 1 Drawing Sheet

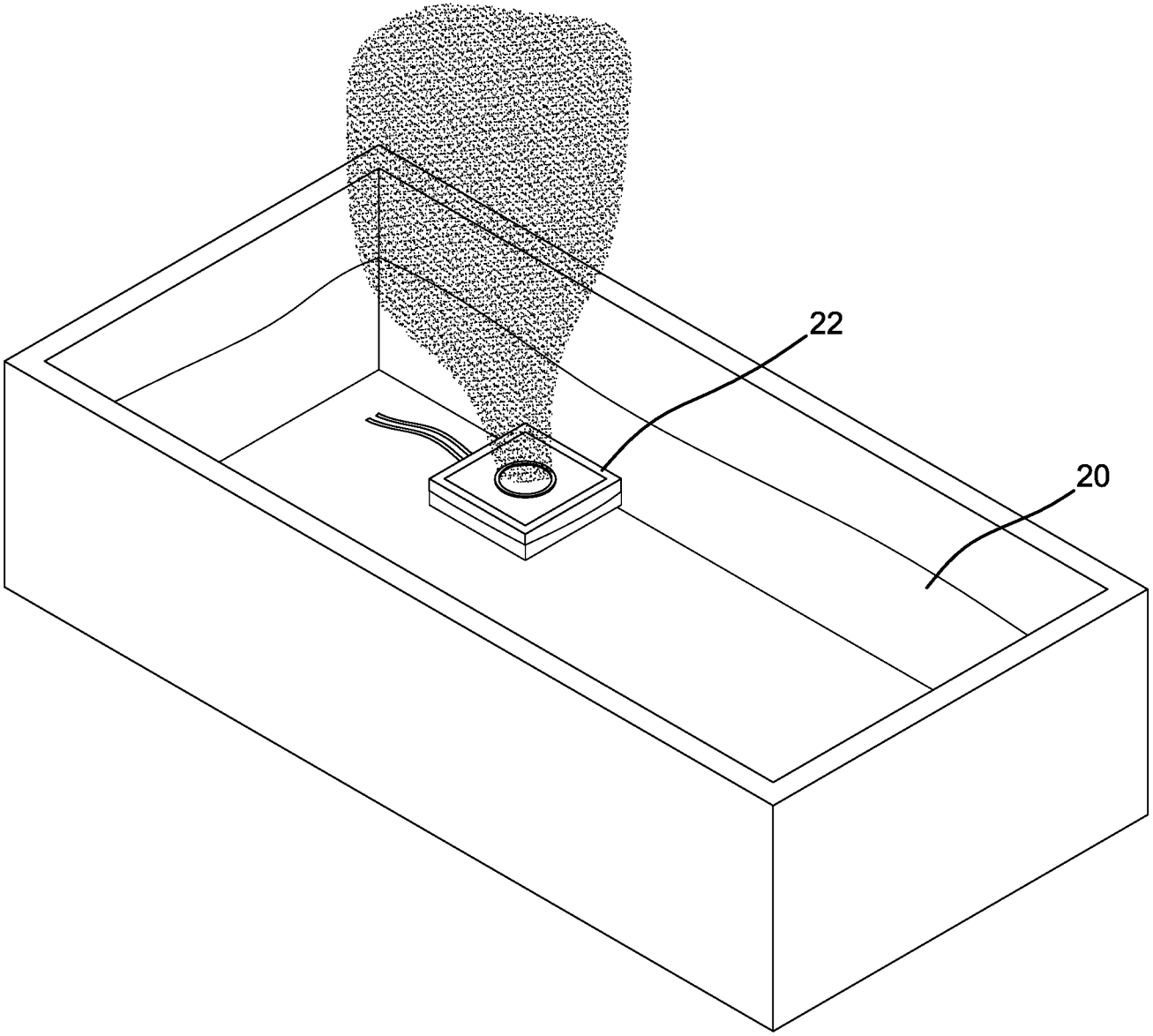
20
22

AQUEOUS SOLUTION CONTAINING CARBOHYDRATE FOR GENERATING SMOKE AND METHOD FOR USING SAME TO GENERATE SMOKE

BACKGROUND OF THE INVENTION

The present invention relates to an aqueous solution containing carbohydrate for generating smoke and a method for using the aqueous solution and, more particularly, to aqueous solution containing carbohydrate for generating smoke harmless to the human body and a method using supersonic waves to vibrate the aqueous solution to generate the smoke.

Stage lamps are used on many performance stages to present backgrounds of various light and shadow effects and light beam effects. Stage lamps generating such effects in the air generally provide a thin layer of smoke in the stage space to provide reflection and refraction, such that the naked eye can see the light and shadow effects and the light beam effects. Therefore, the stage smoke is one of necessities of stage equipment.

Stage smoke effects include smoke effects and mist effects. Early stage smoke effects were only used in stage performance. In recent years, smoke effects are used in more and more places of amusement, and the crowd in a limited space with the smoke effects will inhale the smoke made of chemical materials, resulting in more or less injury to the human body.

BRIEF SUMMARY OF THE INVENTION

An objective of the present invention is to solve the harm to the human body by smoke produced from conventional chemical materials. An aqueous solution containing carbohydrate for generating smoke according to the present invention consists of 91.9-98.95 wt % of pure water, 1-8 wt % of carbohydrate, and 0.05-0.1 wt % of a water soluble aromatic substance of orange flavor.

The smoke produced from the aqueous solution containing carbohydrate according to the present invention contains the water soluble aromatic substance of orange flavor and, thus, will not attract ants that dislike the taste of orange. The aqueous solution containing carbohydrate according to the present invention uses carbohydrate that can be absorbed by the human body, such that the smoke generated from the aqueous solution containing carbohydrate will not harm the human body. In the case of using glucose (which is a necessity to the human body) as the carbohydrate, the smoke generated from the aqueous solution will not harm the human body.

Another objective of the present invention is to provide a method for generating smoke. The method includes preparing an aqueous solution comprising 91.9-98.95 wt % of pure water, 1-8 wt % of carbohydrate, and 0.05-0.1 wt % of a water soluble aromatic substance of orange flavor; and vibrating the aqueous solution at a high frequency, causing gradual atomization from a surface of the aqueous solution to form droplets containing the carbohydrate and having a diameter in a range of 6-20 μm.

The aqueous solution containing carbohydrate according to the present invention can be used to produce droplets having a diameter in a range of 6-20 μm to produce thicker smoke. Following the evaporation of the droplets, the tiny crystalline glucose of a diameter of about 1-5 μm scatters in the air and diffuses the light to create a visual effect (like fogging) which lasts a longer period of time, and these can cooperate with the light from a stage lamp to create light and shadow effects and light beam effects.

The present invention will become clearer in light of the following detailed description of illustrative embodiments of this invention described in connection with the drawings.

DESCRIPTION OF THE DRAWINGS

FIG. 1 shows a diagrammatic perspective view of a supersonic atomizer for generating smoke from an aqueous solution containing carbohydrate according to the present invention.

All FIGURES are drawn for ease of explanation of the basic teachings of the present invention only; the extensions of the FIGURES with respect to number, position, relationship, and dimensions of the parts to form the embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

DETAILED DESCRIPTION OF THE INVENTION

An aqueous solution containing carbohydrate for generating smoke according to the present invention can be used to produce smoke that can stay in the air for a longer period of time and is, thus, suitable to be applied on stage performance. The aqueous solution consists of 91.9-98.95 wt % of pure water ($H_2O$), 1-8 wt % of carbohydrate, and 0.05-0.1 wt % of a water soluble aromatic substance of orange flavor. These ingredients are uniformly mixed to form the aqueous solution 20 suitable for generating smoke. In an example, the carbohydrate is glucose ($C_6H_{12}O_6$). The water soluble aromatic substance of orange flavor can be orange essence, orange essential oil, etc.

A method for generating smoke from the aqueous solution 20 containing carbohydrate comprises preparing an aqueous solution comprising 91.9-98.95 wt % of pure water, 1-8 wt % of carbohydrate, and 0.05-0.1 wt % of a water soluble aromatic substance of orange flavor. The aqueous solution is vibrated at a high frequency, causing gradual atomization from a surface of the aqueous solution 20 to form droplets containing the carbohydrate and having a diameter in a range of 6-20 μm, preferably 8-15 μm.

In an example of using an aqueous solution containing carbohydrate produced from glucose, a supersonic atomizer 22 for generating smoke is placed in the aqueous solution to generate high frequency vibrations. The vibrations caused by the supersonic atomizer 22 decompose the aqueous solution 20 into droplets having a diameter in a range of 6-20 μm. These droplets drift into the air under the kinetic energy produced by the supersonic atomizer 22. Also, the mist-like droplets can expand to a larger or higher area by equipment like fans. These droplets of a small diameter scatter in the air and diffuse the light to create a visual effect like fogging. Furthermore, these droplets of a small diameter evaporate completely within a period of time (about 5-8 seconds), and the glucose in the droplets crystallizes into crystallines of a diameter of about 1-5 μm that stay in the air for a period of time. When light beams are projected to pass through the crystallines, a portion of the light passes, and a portion of the light is reflected or refracted and, thus, generate a clear light and shadow effect and a light beam effect.

In practical tests, when 15 ml of normal water is used to generate smoke by the supersonic atomizer 22, the smoke expands in a space of 10 $m^3$ at 25° C. and vanishes in about 3-10 seconds. In contrast, when 15 ml of the aqueous solution 20 containing carbohydrate according to the present invention is used to generate smoke by the supersonic atomizer 22, the smoke expands in a space of 10 $m^3$ at 25° C. and does not vanish (a clear shadow effect can still be provided when irradiated by light beams) after about 30 minutes.

The aqueous solution containing carbohydrate according to the present invention contains 1-8 wt % of carbohydrate, which reduces the sticking issue to the environment and is advantageous to cleaning of the environment.

The aqueous solution 20 containing carbohydrate according to the present invention can be used to produce droplets having a diameter in a range of 6-20 μm to produce thicker smoke. Following the evaporation of the droplets, the tiny crystalline glucose of a diameter of about 1-5 μm scatters in the air and diffuses the light to thereby create a visual effect (like fogging) which lasts a longer period of time, and these can cooperate with the light from a stage lamp to create light and shadow effects and light beam effects.

The smoke produced from the aqueous solution containing carbohydrate according to the present invention contains the water soluble aromatic substance of orange flavor and, thus, will not attract ants that dislike the taste of orange.

The aqueous solution containing carbohydrate according to the present invention uses carbohydrate that can be absorbed by the human body, such that the smoke generated from the aqueous solution containing carbohydrate will not harm the human body. In the case of using glucose (which is a necessity to the human body) as the carbohydrate, the smoke generated from the aqueous solution will not harm the human body.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A smoke generating system comprising:

an aqueous solution containing carbohydrate for generating smoke, wherein the aqueous solution consists of 91.9-98.5 wt % of pure water, 1-8 wt % of carbohydrate, and 0.05-0.1 wt % of a water soluble aromatic substance of orange flavor; and a supersonic atomizer in contact with the aqueous solution, the supersonic atomizer producing vibrations having a frequency sufficient to decompose the aqueous solution into droplets.

2. The smoke generating system as claimed in claim 1, wherein the carbohydrate is glucose.

3. A method for generating smoke, comprising preparing an aqueous solution comprising 91.9-98.5 wt % of pure water, 1-8 wt % of carbohydrate, and 0.05-0.1 wt % of a water soluble aromatic substance of orange flavor; and vibrating the aqueous solution at a frequency sufficient to cause atomization from a surface of the aqueous solution to form droplets containing the carbohydrate and having a diameter in a range 6-20 pm.

4. The method for generating smoke as claimed in claim 3, wherein the carbohydrate is glucose.

5. The method for generating smoke as claimed in claim 3, wherein the diameter of the droplets is in a range of 8-15 μm.

6. The smoke generating system as claimed in claim 1, wherein the diameter of the droplets is in a range of 6-20 μm.

7. The smoke generating system as claimed in claim 1, wherein the droplets have an evaporated state and, in the evaporated state, the carbohydrate is crystallized into crystallines.

8. The smoke generating system as claimed in claim 7, wherein the crystallines have a diameter of 1-5 μm.

9. A smoke effect comprising atomized droplets formed from an aqueous solution consisting of 91.9-98.95 wt % of pure water, 1-8 wt % of carbohydrate, and 0.05-0.1 wt % of a water soluble aromatic substance of orange flavor, wherein the diameter of the droplets is in a range of 6-20 μm.

10. The smoke effect as claimed in claim 9, wherein the atomized droplets have an evaporated state and, in the evaporated state, the carbohydrate is crystallized into crystallines.

11. The smoke effect as claimed in claim 10 wherein the crystallines have a diameter of 1-5 μm.

12. The smoke generating system as claimed in claim 1, further comprising a light source capable of generating a light beam, wherein the light beam is capable of being diffused by the droplets.

13. The smoke effect as claimed in claim 9, wherein the carbohydrate is glucose.

* * * * *